US009556760B2

(12) United States Patent
Methley et al.

(10) Patent No.: US 9,556,760 B2
(45) Date of Patent: Jan. 31, 2017

(54) LOW FRICTION SHIM SURFACE

(71) Applicant: MECHADYNE INTERNATIONAL LTD., Oxfordshire (GB)

(72) Inventors: Ian Methley, Witney (GB); Timothy Mark Lancefield, Warwickshire (GB)

(73) Assignee: MECHADYNE INTERNATIONAL LTD., Kirlington, Oxfordshire (GB)

( * ) Notice: Subject to any disclaimer, the term of this patent is extended or adjusted under 35 U.S.C. 154(b) by 0 days.

(21) Appl. No.: 14/651,275

(22) PCT Filed: Dec. 10, 2013

(86) PCT No.: PCT/IB2013/060775

§ 371 (c)(1),
(2) Date: Jun. 11, 2015

(87) PCT Pub. No.: WO2014/091404

PCT Pub. Date: Jun. 19, 2014

(65) Prior Publication Data

US 2015/0322827 A1 Nov. 12, 2015

(30) Foreign Application Priority Data

Dec. 11, 2012 (EP) ..... 12196607

(51) Int. Cl.
*F01L 1/18* (2006.01)
*F01L 1/46* (2006.01)
(Continued)

(52) U.S. Cl.
CPC .. *F01L 1/46* (2013.01); *F01L 1/18* (2013.01); *F01L 1/185* (2013.01); *F01L 1/205* (2013.01);
(Continued)

(58) Field of Classification Search
CPC ..... F01L 1/18; F01L 1/344; F01L 1/46; F01L 2001/0473; F01L 2001/0476
(Continued)

(56) References Cited

U.S. PATENT DOCUMENTS 8,127,727 B2 * 3/2012 Methley ..... F01L 13/0047 123/90.16
2010/0139595 A1 6/2010 Seo

FOREIGN PATENT DOCUMENTS

DE 10147603 4/2003
GB 2378729 2/2003
(Continued)

OTHER PUBLICATIONS

PCT International Searching Authority; PCT International Search Report dated May 16, 2014.

*Primary Examiner* — Ching Chang
(74) *Attorney, Agent, or Firm* — Allen Dyer Doppelt Milbrath & Gilchrist

(57) ABSTRACT

A variable valve actuating mechanism comprising a camshaft having two concentric cam lobes that may be rotated relative to one another a summation lever engaging with both cam lobes, a valve actuating rocker pivotally connected to the summation lever and engaging with a hydraulic lash adjuster at a first end and with a valve at a second end, and a shim surface movable with the pivot axis connecting the summation lever to the valve actuating rocker for limiting the expansion of the hydraulic lash adjuster to control clearance in the rocker system, wherein, in order to reduce friction, the shim surface abuts with a stationary stop surface that forms part of a camshaft support bearing.

12 Claims, 11 Drawing Sheets

(51) Int. Cl.

| | |
|---|---|
| ***F01L 1/344*** | (2006.01) |
| ***F01L 1/20*** | (2006.01) |
| ***F01L 1/24*** | (2006.01) |
| ***F01L 13/00*** | (2006.01) |
| *F01L 1/047* | (2006.01) |

(52) U.S. Cl.
CPC ..... *F01L 1/2405* (2013.01); *F01L 1/344* (2013.01); *F01L 13/0047* (2013.01); *F01L 2001/0473* (2013.01); *F01L 2001/0476* (2013.01)

(58) Field of Classification Search
USPC ..... 123/90.16, 90.39, 90.44
See application file for complete search history.

(56) References Cited

FOREIGN PATENT DOCUMENTS

| | | |
|---|---|---|
| GB | 2449096 | 11/2008 |
| GB | 2467334 | 8/2010 |
| GB | 2473250 | 3/2011 |
| GB | 2480638 | 11/2011 |

* cited by examiner

LOW FRICTION SHIM SURFACE

CROSS-REFERENCE TO RELATED APPLICATIONS

This application is the §371 National Stage Entry of International Application No. PCT/IB2013/060775, filed on Dec. 10, 2013, which claims the benefit of European Patent Application No. 12196607.1, filed on Dec. 11, 2012, the contents of which applications are herein incorporated by reference in their entirety.

FIELD OF THE INVENTION

The present invention relates to variable valve lift and duration systems for internal combustion engines, and more specifically to the reduction of valve train friction in order to reduce fuel consumption.

BACKGROUND OF THE INVENTION

This invention relates to the variable lift and duration mechanism (VLD) previously developed by the applicants of the present invention. It utilises two concentric camshafts the phase of which may be altered relative to one another. The purpose of these two camshafts is that the lift imparted to the valve is determined by the sum of the lift contributed by each camshaft profile. No lift is imparted to the valve when either camshaft is "off-cam". By varying the phase of the two camshafts, the cumulative lift and duration can be altered. This results in directly altering the opening duration and lift of the engine valve, be it inlet or exhaust.

The cumulative lift is achieved by the use of a summation lever having cam followers in contact with both sets of cams. If either cam follower is on the base circle of the associated cam, the summation lever merely rocks about a pivot axis connecting it to a valve actuating rocker. If both cam followers are in contact with the cam lobes, the summation lever is displaced downwards, and pushes down on the actuating rocker which then pivots about a hydraulic lash adjuster to open the engine valve.

A fundamental aspect of the VLD system operation is that clearance must exist in the system when the valve(s) is closed and the rocker system moves through its 'return' or 'reset' motion. If the system were to be designed with no clearance, the effect of phasing the second cam lobe with respect to the first cam lobe to alter the main lift event would either introduce clearance, if the valve lift duration is increased, or cause an additional valve lift to occur during the return motion, if the valve lift duration is reduced.

Ensuring that the correct amount of clearance exists in the system is essential in order for the valve motion to correspond to the theoretical lift characteristic. Differing levels of clearance between engine cylinders will therefore manifest itself as valve lift variations between cylinders. This will cause different airflow through each cylinder of the engine, potentially causing misfires or poor engine stability.

Typically a shim surface, which contacts with the rotating portion of the camshaft, has been used to limit the expansion of the hydraulic lash adjuster (HLA) and therefore control this clearance. The clearance within each VLD rocker system can be set by either removing material from this shim surface or adjusting its location. Conventionally, a shim surface on the valve actuating rockers abuts with a collar on the side of the cam lobes to limit HLA inflation and therefore control clearance.

Using a surface on the camshaft to control clearance rather than a fixed stop surface attached to the cylinder head is advantageous because it prevents any variations in cylinder head geometry from affecting the operating clearance of the VLD rocker system. The clearance is defined only by the VLD rocker system and the camshaft, allowing any variations in all of the other components in the system to be compensated for by the HLA.

Whilst this design works very well to control clearance, the sliding interface between the shim surface and the camshaft collar results in a small frictional torque being applied to the camshaft that would not be present in a conventional valve train. There is also the potential for wear at this interface which would alter the clearance of the valve train and therefore potentially cause the valve to lift during the return motion of the rocker system.

Whilst such frictional losses from this interface are only considered minor, with strict fuel economy legislation and resulting efforts to improve engine efficiency it is desirable to eliminate any unnecessary frictional losses. This is particularly important for valve lift control systems which are primarily intended to deliver a fuel economy benefit.

It must also be noted that in common with all variable valve lift systems, the VLD rocker system has a number of additional component interfaces that would not be present in a conventional roller finger follower system. Whilst the VLD system will tend to have lower friction than a conventional valve train when it is running at its lower valve lift settings, at higher lifts the friction resulting from these additional interfaces becomes more significant. Furthermore, when operating at higher lifts the VLD rocker system will tend to increase the loads on the camshaft bearings, potentially increasing the camshaft frictional torque.

SUMMARY OF THE INVENTION

With a view to mitigating the foregoing disadvantages, the present invention provides a variable valve actuating mechanism comprising a camshaft having two concentric cam lobes rotatable relative to one another, a summation lever engaging with both cam lobes, a valve actuating rocker pivotally connected by a pivot shaft to the summation lever and engaging with a hydraulic lash adjuster at a first end and with a valve, and a shim surface movable with the pivot shaft connecting the summation level to the valve actuating rocker for limiting the expansion of the hydraulic lash adjuster to control clearance in the rocker system, wherein in order to reduce friction, the shim surface abuts with a stationary stop surface that forms part of a camshaft support bearing. The stationary stop surface is an outer bearing race of a rolling element bearing, a bearing bush or a split bearing shell and the shim surface is on a separate component mounted on the pivot shaft connecting the summation lever to the valve actuating rocker.

Additional advantages are further provided by additional aspects of the present invention that include:

- The camshaft support bearing may be a rolling element bearing.
- The shim surface may be provided on the valve actuating rocker.
- The shim surface may be a removable component supported by a pivot shaft connecting the valve actuating rocker to the summation lever.
- A rolling element bearing may be situated between the removable shim component and the pivot shaft.

The pivot connection between the valve actuating rocker and the summation lever may include a rolling element bearing.

A single rolling element bearing may transfer the loads from both the shim and the valve actuating rocker to the pivot shaft.

The rolling element bearing may comprise cylindrical rolling elements.

The preferred embodiment of the invention may further include an adjustment mechanism for altering the position of the stationary surface against which the shim surface abuts to alter the clearance of the rocker system.

The adjustment mechanism may alter the position of the stationary surface by incremental rotation of an eccentric surface rotating about the camshaft.

The eccentric surface may be formed as part of the camshaft bearing and the camshaft bearings are fitted in pairs such that the stop position for two shim surfaces adjacent each cylinder head mounting can be adjusted independently.

An additional component may be assembled to the outer raceway of the bearing to provide the stop surface.

The additional component may be a rolling bearing.

The additional component may be a graded part-cylindrical surface for setting the rocker system clearance.

The additional component may act to position the outer race axially within the cylinder head journal.

The stationary stop surface may be operative to permit passage of lubricant into the camshaft support bearing.

This invention details several embodiments of low friction solutions for controlling VLD rocker clearance, all of which use a stationary, non-rotating surface rather than a rotating surface against which a non-rotating shim abuts.

The preferred embodiment of the present invention uses a stationary outer raceway or bearing shell, which is part of the main camshaft bearing assembly, to provide a limit stop for the VLD rocker system shims and therefore controls VLD clearance.

The invention takes advantage of the fact that many future camshafts will be assembled with rolling element camshaft bearings to reduce friction (in particular at low engine speeds) and the use of features on these bearings to control VLD clearance is particularly advantageous.

BRIEF DESCRIPTION OF THE DRAWINGS

The present invention will now be described in detail with reference to the attached drawings in which.

DETAILED DESCRIPTION OF PREFERRED EMBODIMENTS

Starting with the prior art figures of 10*a* and 10*b*, a known variable lift and duration (VLD) rocker assembly is shown. This shows three cam lobes for each valve (or pair of valves) mounted on two co-axial camshafts. Two of the three lobes having the same cam profile rotate as a pair on one camshaft and the third rotates on the other. The reason for this is to eliminate any asymmetry which may result in twisting of the components following the cam profiles. Both coaxial camshafts rotate together at the same speed, but also may rotate relative to one another altering the phasing and in turn affecting the valve duration and lift.

The three cam lobes act on a three fingered summation lever. Each finger includes a cam follower or roller which contacts the cam surface. Two fingers and corresponding followers are arranged at one end of the lever in contact with the pair of cams on one camshaft, and one finger and roller in contact with the cam on the other camshaft at the opposite end.

The purpose of these two camshafts is that the lift imparted to the valve is determined by the sum of the lift contributed by each camshaft profile. The cumulative lift is transferred to the valve by displacing the summation lever downwards.

If either cam follower is on the base circle of the associated cam, the summation lever merely rocks about a pivot axis connecting it to a valve actuating rocker 12. If both cam followers are in contact with the cam lobes, the summation lever is displaced downwards, and pushes down on the actuating rocker which then pivots about a hydraulic lash adjuster to open the engine valve. The summation lever is pivotally connected to the valve actuating rocker 12, which actuates the valve. The hydraulic lash adjuster (HLA) 16 is provided to urge the rocker against the force of the valve spring to a rest position.

Conventionally, a shim surface 10 on the valve actuating rocker 12 abuts with a collar 14 on the side of the cam lobes to limit HLA 16 inflation and therefore control clearance. The clearance within each VLD rocker system can be set by either removing material from the shim surface or adjusting its position.

The disadvantage of this is the sliding contact between the shim surface 10 and the camshaft collar 14 as the camshaft rotates, results in a small frictional torque being applied to the camshaft that would not be present in a conventional valve train. There is also the potential for wear at this interface which would alter the shimming of the valve train and potentially result in the valve lifting unintentionally.

Figure 10A:
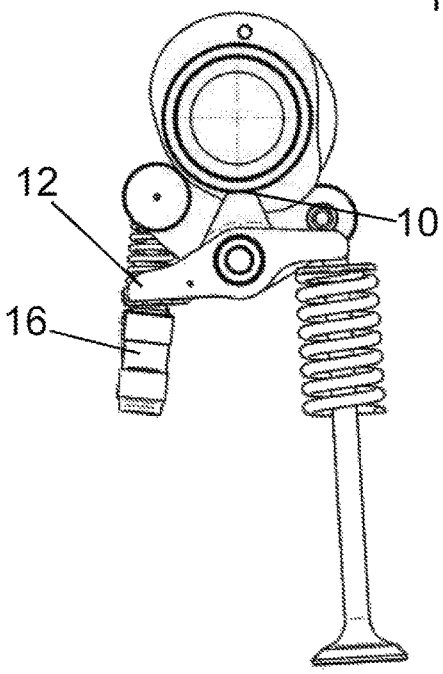
Figure 10a (PRIOR ART)
FIGS. 10*a* and 10*b* show the clearance control system typically used in the prior art.
Figure 10B:
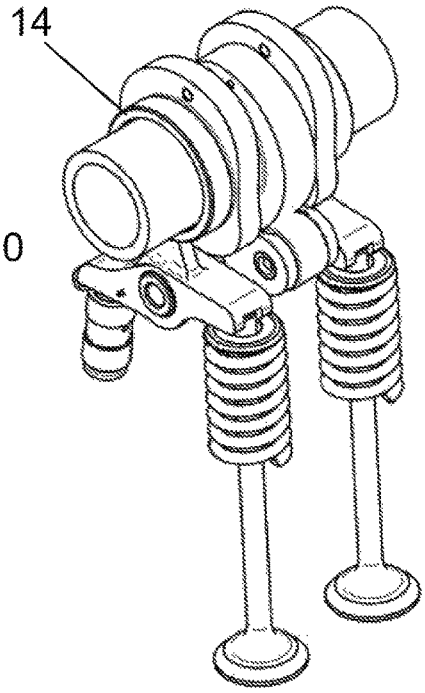
Figure 10b (PRIOR ART)

In the enclosed embodiments, the bush, shell or outer raceway of the camshaft bearing is extended so that it is wider than it needs to be in a conventional application to provide a surface that can act as a stop for the VLD rocker system shim surface. The outer race is clamped in position on the cylinder head and is therefore stationary and not free to rotate. When the shim surface makes contact with this surface, there is minimal frictional loss compared to the sliding interface of the prior art shown on FIGS. 10*a* and 10*b* and mentioned in the introduction.

Patent application GB1111184.6 shows how bearing bushes may be fitted to a concentric camshaft in order to allow the camshaft bearings to be located directly above the cylinder head bolts. It follows that the length of such bearing bushes can be extended further towards the camshaft lobes in order to provide a stationary surface as required by the present invention.

Please note, though although some features are common to each embodiment, new reference numerals are provided for all features to avoid confusion between the embodiments. Each embodiment is numbered with the same main figure number to which it refers.

First Embodiment

Figure 1:
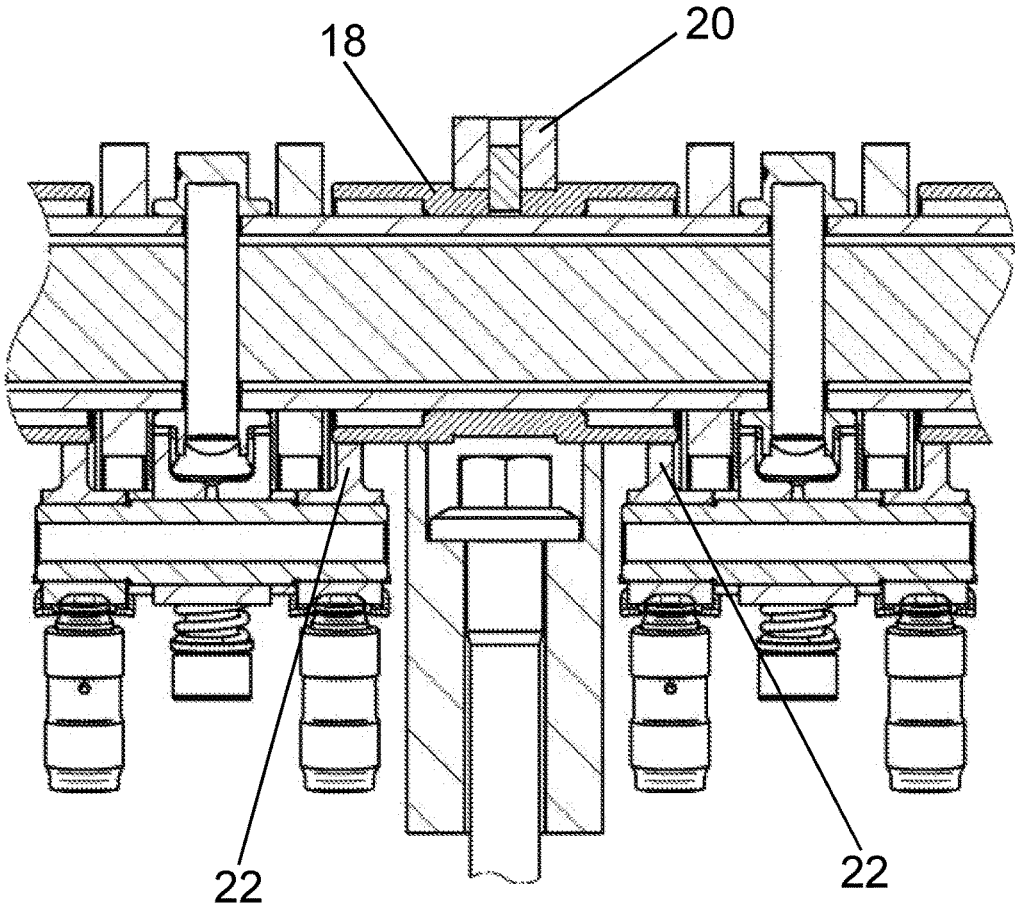
FIG. 1 shows a section view through a first embodiment of the present invention.

The sectional view of FIG. 1 shows a first embodiment of the invention that uses a bearing bush to support the camshaft in the cylinder head in order to provide a bearing surface above the cylinder head bolt. The bearing bush 18 extends either side of its mounting 20 in the cylinder head to provide a stationary contact surface for the shim formations 22 on the two valve actuating rockers.

Alternatively, it would be possible to achieve a similar function with split bearing shells fitted to the cylinder head instead of a bearing bush mounted to the camshaft.

Second Embodiment

Figure 2A:
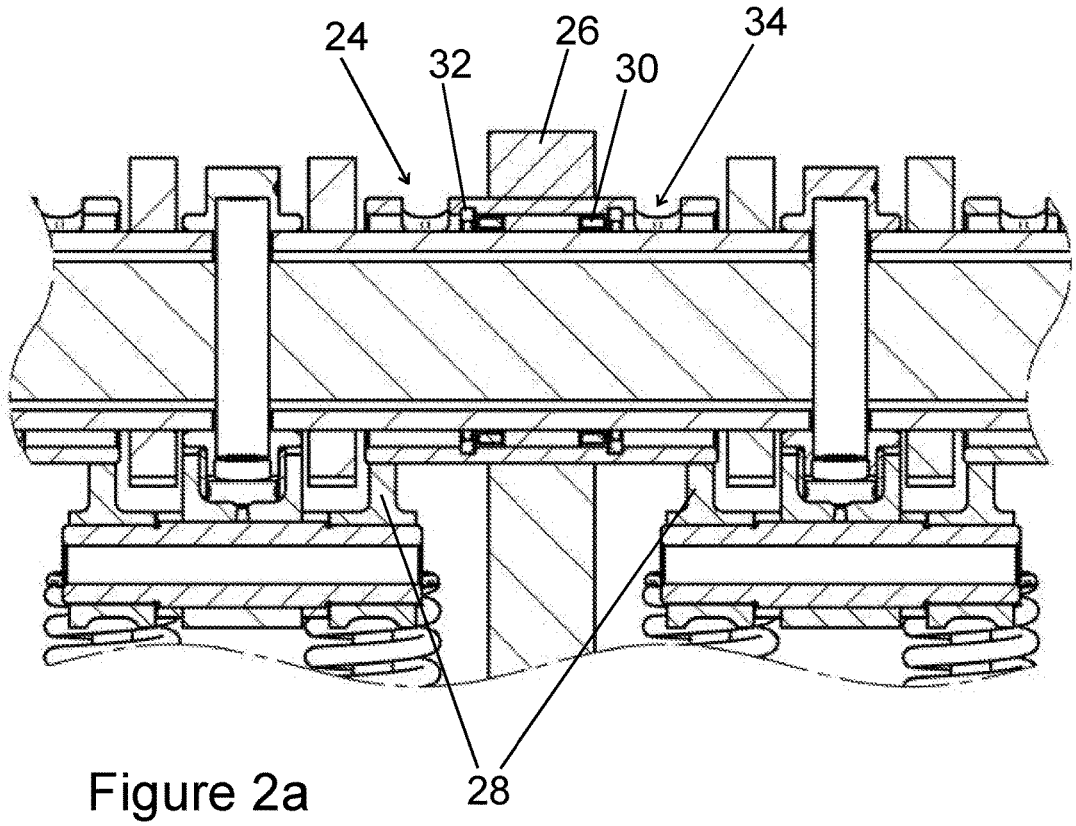
FIG. 2*a* shows a section view through a second embodiment of the present invention.

The section view in FIG. 2*a* shows a second application example of this invention using roller bearings fitted to the camshaft. The outer raceway 24 of the roller bearing extends either side of the camshaft mounting 26 and it is this which contacts with shim formations 28 on the valve actuating rockers. The inner rolling element and cage assembly 30 are retained in position by clips 32 that fit within internal grooves on the outer raceway surface.

Features 34 can also be provided if necessary to improve the ability of oil to enter the outer raceway and lubricate the roller bearing.

Figure 2B:
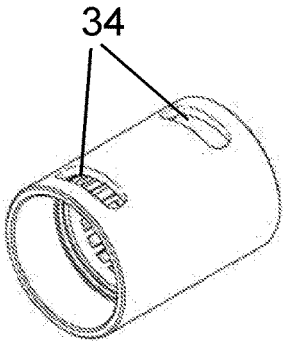
FIGS. 2*b* and 2*c* show two possible methods for improving the oil supply to camshaft support bearings.
Figure 2C:
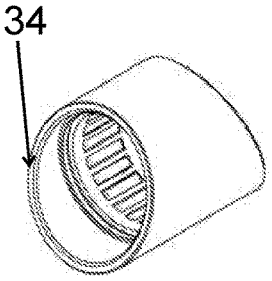

FIGS. 2*b* and 2*c* show two possible designs for allowing oil mist to collect inside the outer raceway 24 for lubricating the roller bearing. In FIG. 2*b* the features 34 refers to slots cut in the upper side of the extended raceway, the lower side of the non-rotating outer raceway has no such slots to increase its integrity, ensuring the strength required to act as the abutment surface to resist the motion of the shim protrusions 28. In FIG. 2*c*, the required structural integrity in the lower side while allowing ingress of oil mist in the upper side is achieved by forming the axial end plane of the extended outer raceway at an incline to the rotational access of the camshaft.

Third Embodiment

Figure 3A:
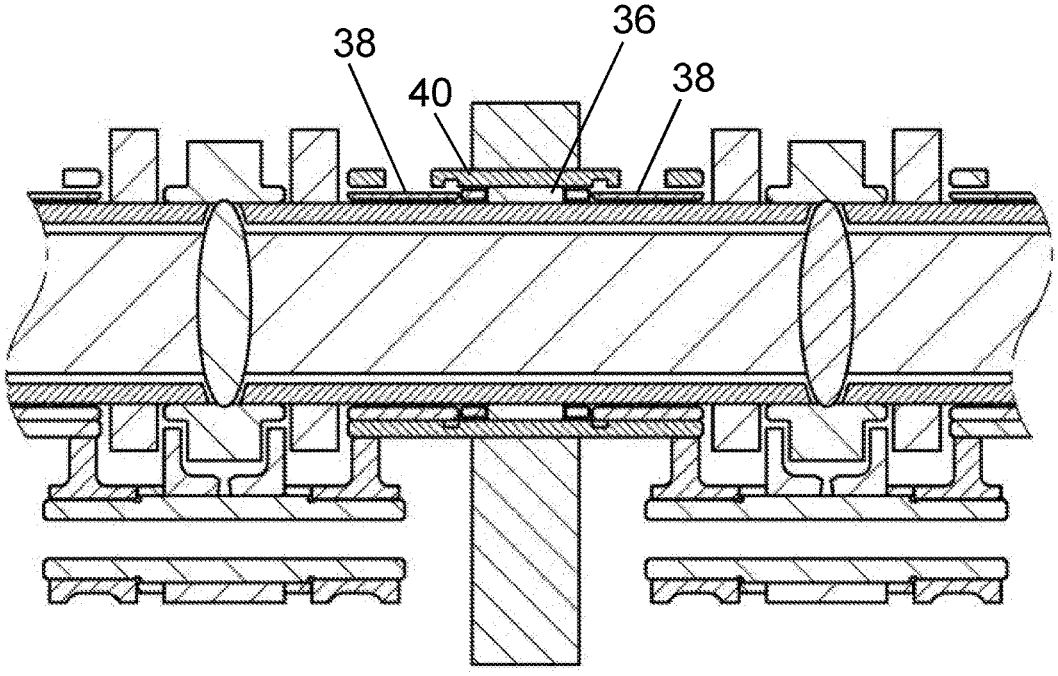
FIG. 3*a* shows a section through a third embodiment of the present invention

This embodiment, shown in FIG. 3*a*, is identical to the second embodiment in many respects. It differs in that the inner rolling element and cage assembly 36 are retained by two sleeves 38 that are an interference fit with the inner diameter of the outer raceway 40. Alternatively, a plastic cage assembly may be used to centralise the bearing and the rollers in this embodiment.

Figure 3B:
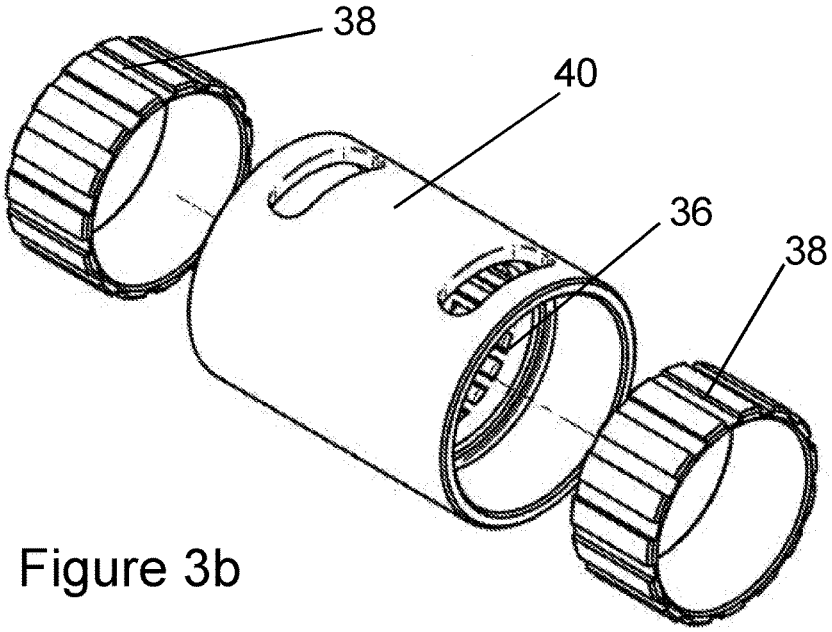
FIG. 3*b* is an exploded view of the rolling element bearing assembly of FIG. 3*a;*

FIG. 3*b* illustrates how features in the outer raceway 40 of the bearing and the two retaining sleeves 38 can be used to ensure that the rolling element and cage assembly 36 of the bearing are provided with lubrication. These features are similar to those shown in FIG. 2*b* with reference to the second embodiment. Note that the retaining sleeves 38 have a castellated cross-section which in combination with the slots in the outer raceway 40 ensure that lubrication oil can reach the inner rolling element and cage assembly.

Fourth Embodiment

The fourth embodiment is very similar to the third embodiment above, except that it has no shim formations on the valve actuating rocker 48. Instead separate removable shim components 42 are mounted on the connecting pivot shaft 44 which attaches the rocker to the summation lever. The removable shim components 42 are retained in place by end caps 46 and can either be an interference fit on the pivot shaft 44 or constrained to rotate with the valve actuating rocker 48. The advantage of this arrangement over the third embodiment is that it significantly reduces the overall length of the bearing outer raceway 50. Each removable shim component 42 is also a simple part that can be graded to alter the valve train clearance when assembled with the camshaft.

Figure 4A:
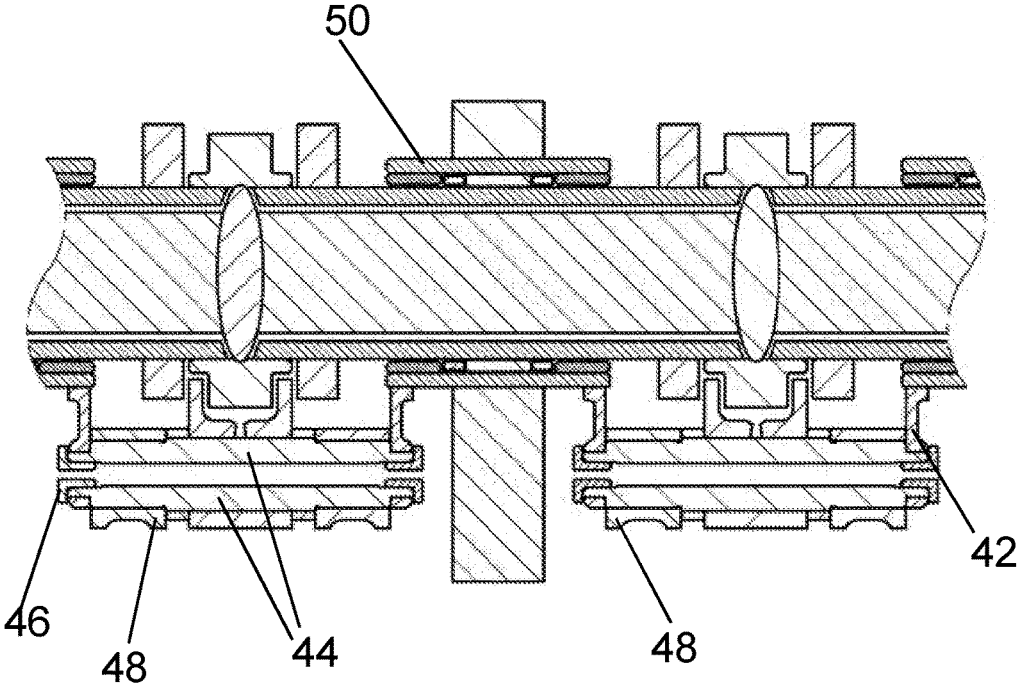
FIG. 4*a* shows a section view through a fourth embodiment of the present invention.
Figure 4B:
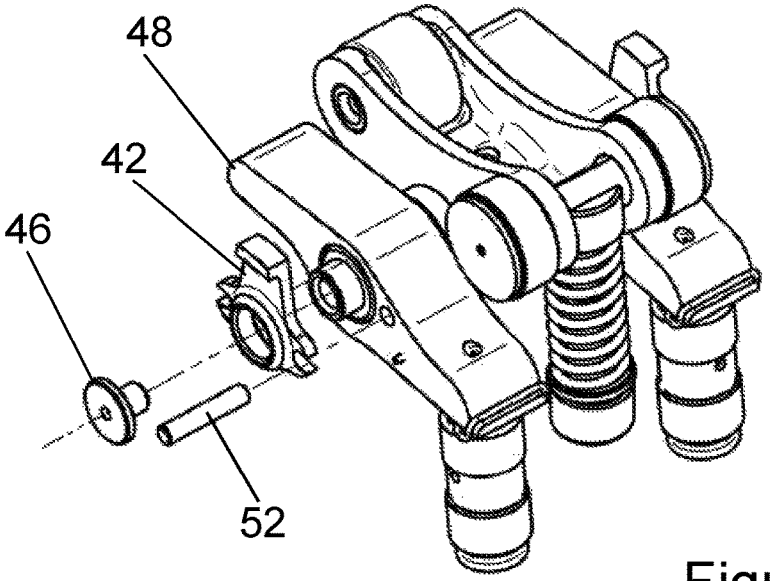
FIG. 4*b* shows an isometric view of the rocker system and removable shim components of the fourth embodiment.

FIG. 4*b* shows the separate shim components in more detail. In this case a pin 52, fitted to the valve actuating rocker 48, is used to align the removable shim component 42 before it is retained in place by end cap 46.

Fifth Embodiment

Figure 5A:
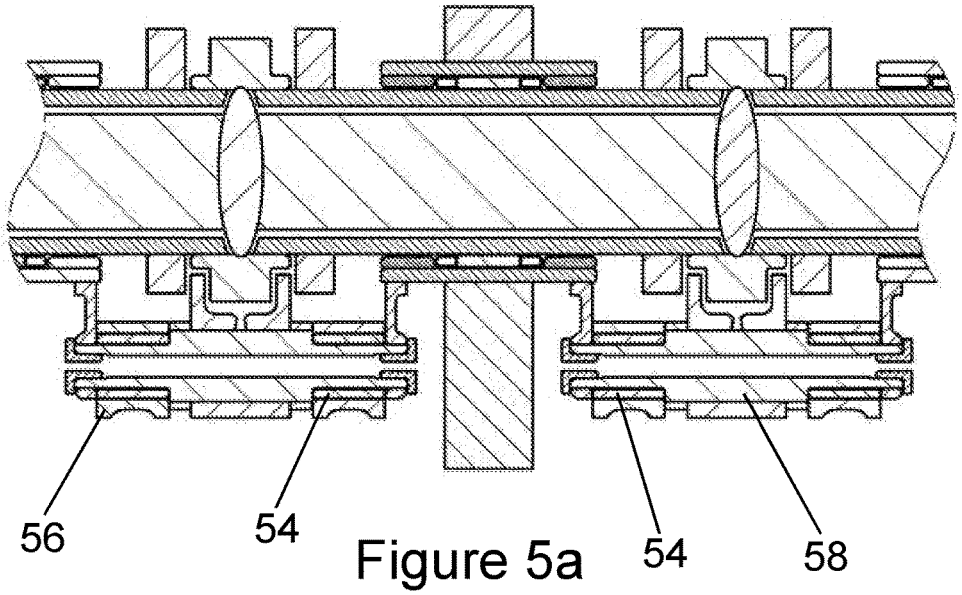
FIG. 5*a* shows a section view through a fifth embodiment of the present invention.
Figure 5B:
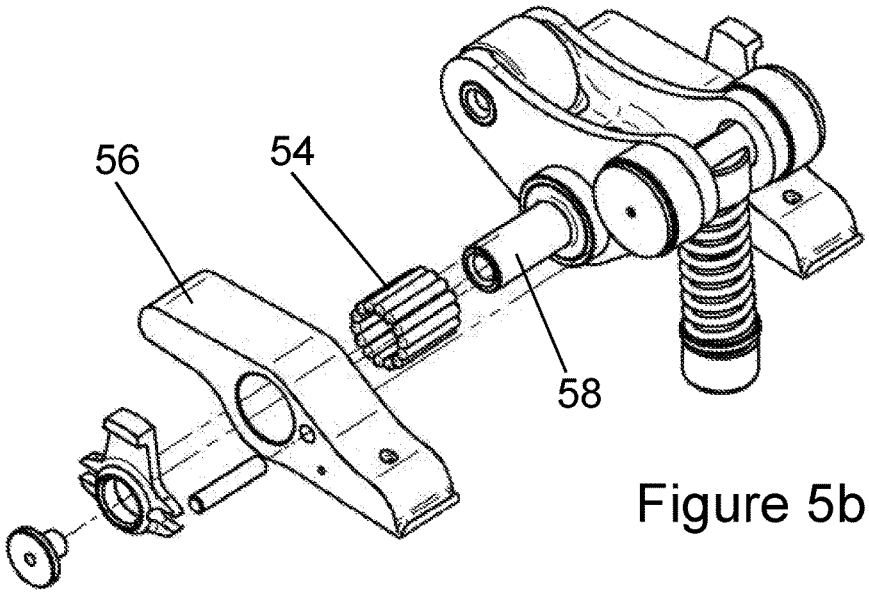
FIG. 5*b* shows an exploded view of the rocker and summation lever of FIG. 5*a;*

The fifth embodiment differs improves on the fourth embodiment by reducing valve train friction further. It provides a needle roller raceway 54 at the interface between the valve actuating rocker 56 and the pivot shaft 58. This can be seen in section in FIG. 5*a* and in exploded form in FIG. 5*b*.

Sixth Embodiment

Figure 6:
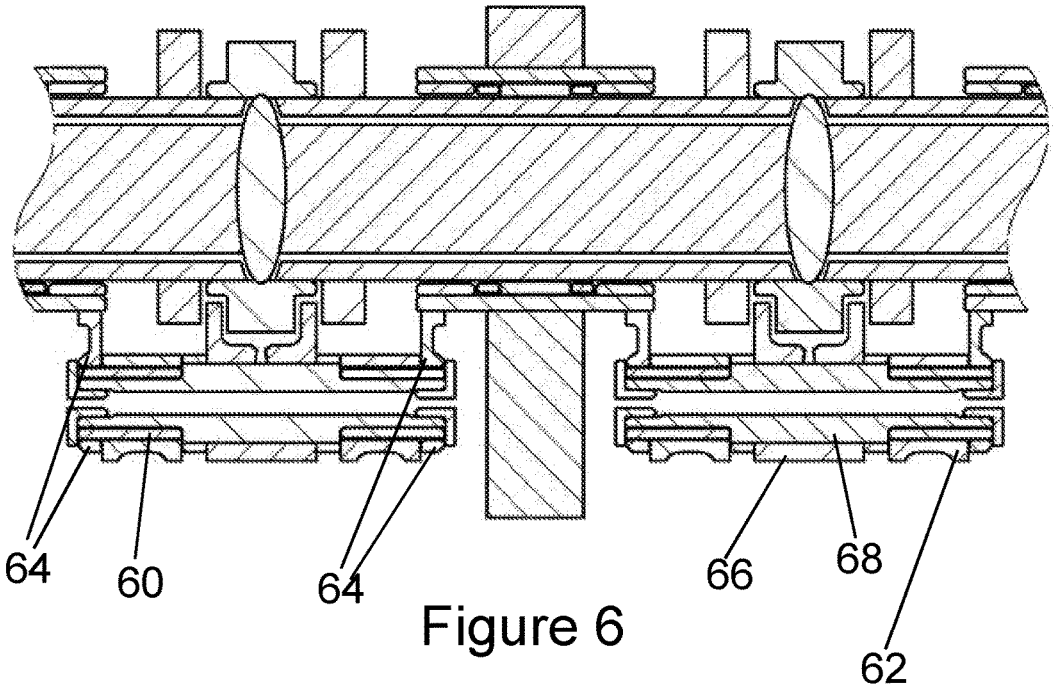
FIG. 6 shows a section view through a sixth embodiment of the present invention.

The fifth and sixth embodiments are much the same except that the cylindrical needle rollers 60, in FIG. 6, extend underneath both the valve actuating rockers 62 and the removable shim components 64. This design is advantageous if the summation lever 66 and the pivot shaft 68 are fixed in rotation to each other. If this is the case, then when the summation lever rotates whilst the valve (not shown) is on its seat, there are relatively low levels of friction between the pivot shaft 68 and the shim components/valve actuating rocker 62.

Seventh Embodiment

Figure 7A:
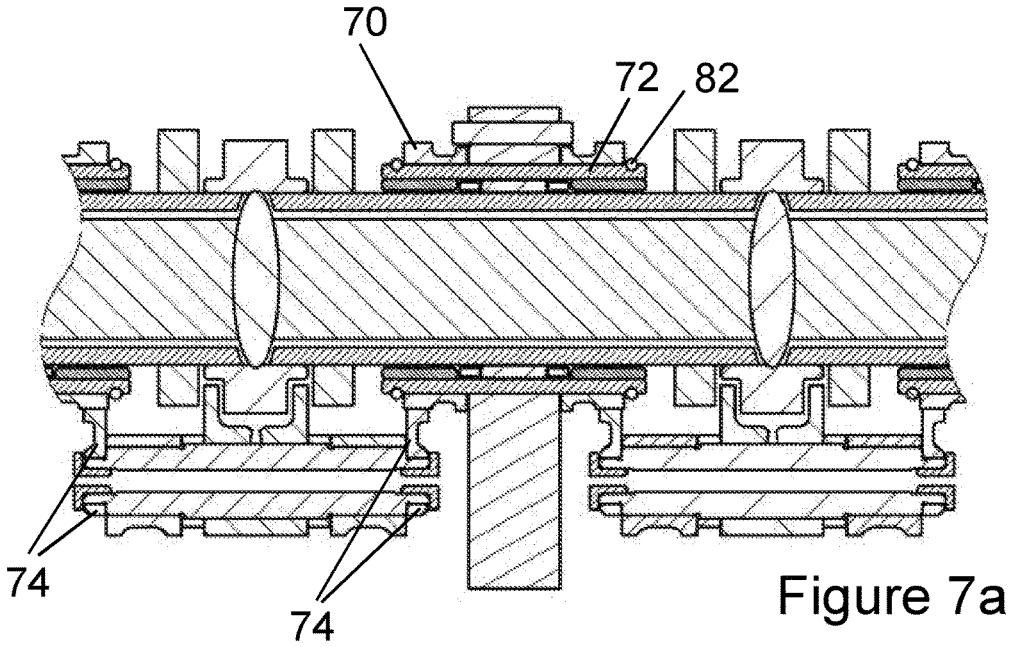
FIG. 7*a* shows a section view through a seventh embodiment of the present invention.

The seventh embodiment, shown in FIG. 7*a*, further includes an extra adjuster component 70 placed in-between the outer diameter of the outer raceway 72 and the removable shim component 74 on the valve train pivot shaft. The circular mating surface 76 between the adjuster 70 and the shim component 74 has an eccentric centre (the centre is offset from the centreline of the camshaft). The effect of rotating the adjuster is to change the clearance within the VLD rocker system without any need for component substitution.

Figure 7B:
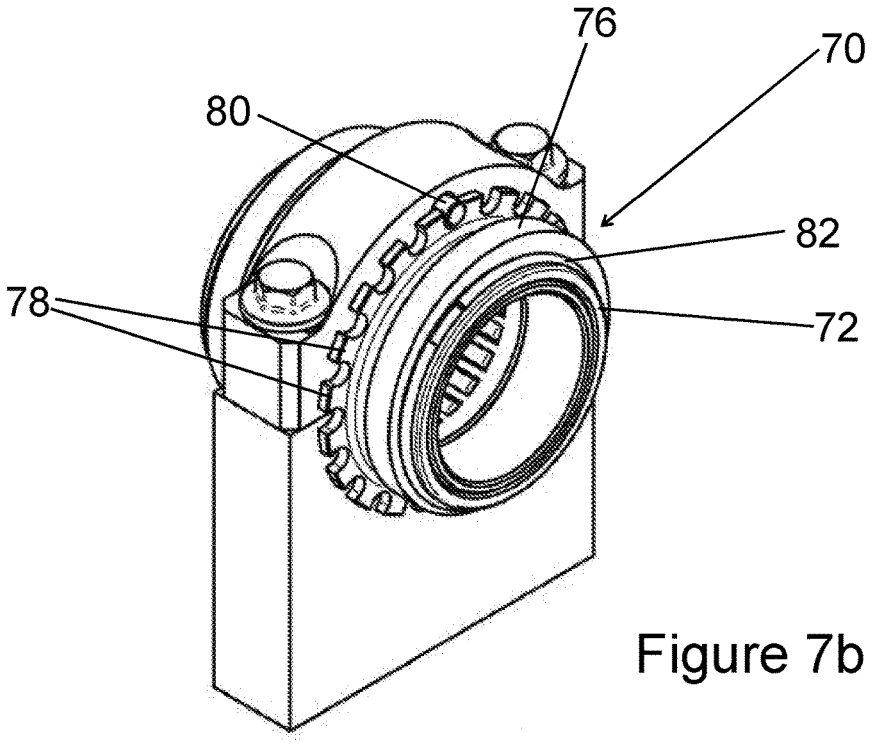
FIG. 7*b* shows an isometric view of the cam bearing and eccentric adjuster assembly of FIG. 7*a;*

For a detailed understanding of how the adjuster works, FIG. 7*b* shows an enlarged view of the relevant components. The eccentric adjuster 70 is toothed, the teeth 78 engage with a pin 80 that is mounted on to the cam bearing cap to prevent rotation whilst the engine is running. To make an adjustment, clip 82 is removed enabling the adjuster 70 to slide axially. It may then disengage from pin 80, rotate and then re-engage with the pin by sliding in the opposite direction. Clip 82 is then assembled back in place before the engine is re-started. Alternatively the cam bearing cap may be removed to allow the adjuster 70 to be rotated and then replaced to secure it in position. While this is one example of how to alter the clearance without substitution of components, there are many different methods to control the rotational position of the adjuster and secure it relative to the rocker mechanism.

Eighth Embodiment

As an alternative to the adjustment system shown in FIGS. 7*a* and 7*b*, a similar function can also be achieved using bearing bushes to support the camshaft—as previously discussed in relation to the first embodiment.

In this case, a pair of bearing bushes 84 is used to support the camshaft and each has an eccentric surface 86 which is contacted by the shim formations 88 on the valve actuating rockers. The bearing bushes can be fixed in a number of different rotational positions such that the clearance of the rocker system can be adjusted by the movement of the eccentric surface 86. It is necessary to use a pair of support bushes so that the clearance of the adjacent rocker systems can be adjusted independently.

Figure 8A:
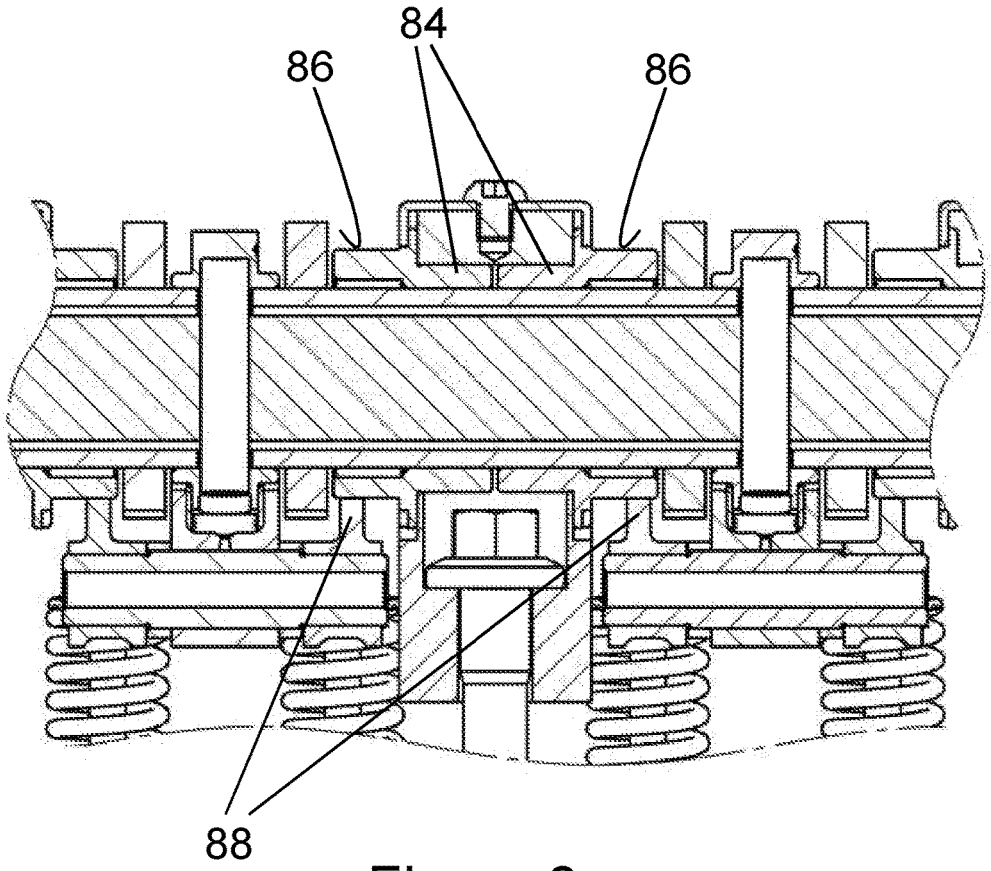
FIG. 8*a* shows a section view through an eighth embodiment of the present invention.
Figure 8B:
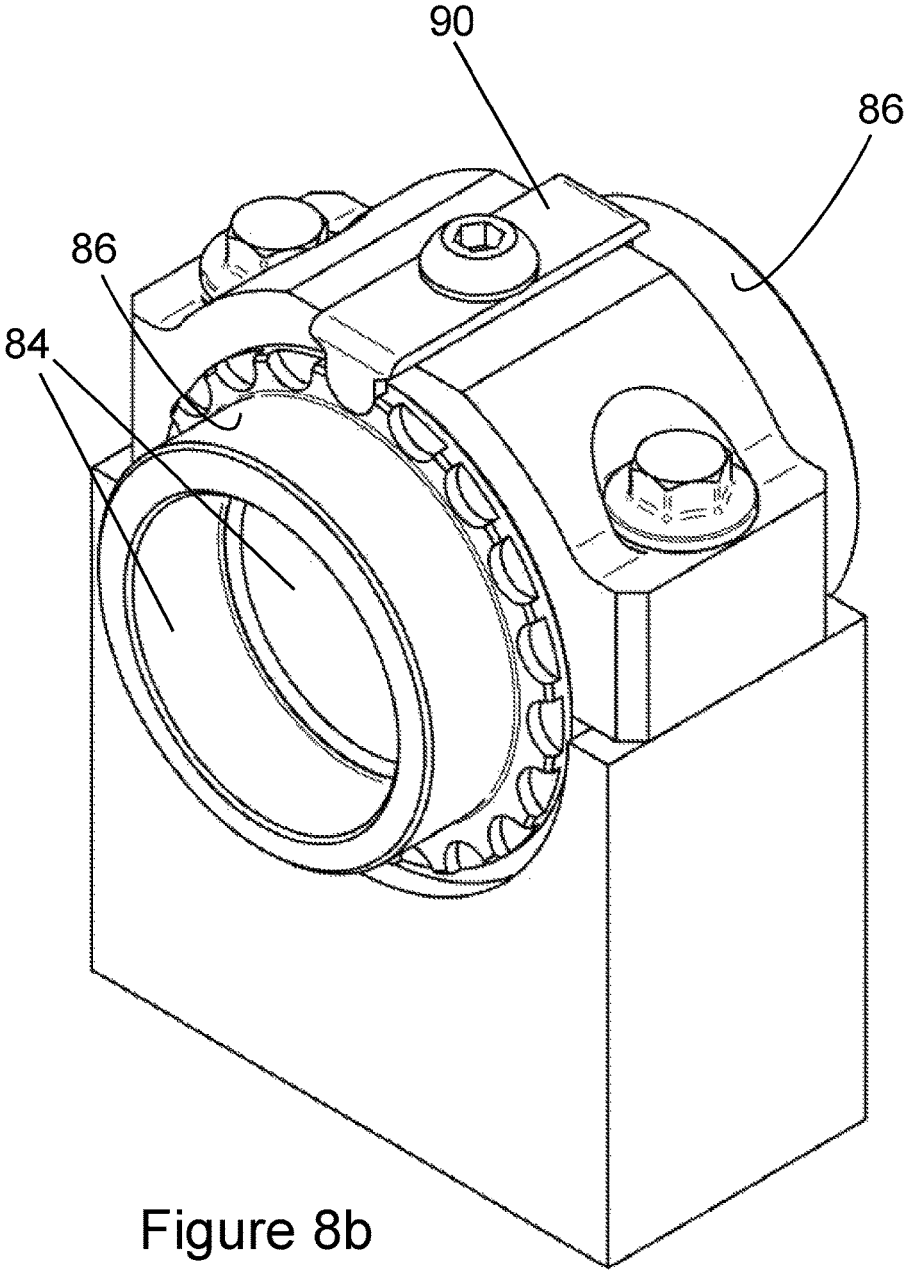
FIG. 8*b* shows an isometric view of the eccentric cam bush adjuster system of FIG. 8*a;*

An isometric view of the camshaft bushes and the clamp 90 to fix their rotational position is shown in FIG. 8*b*.

Ninth Embodiment

Figure 9:
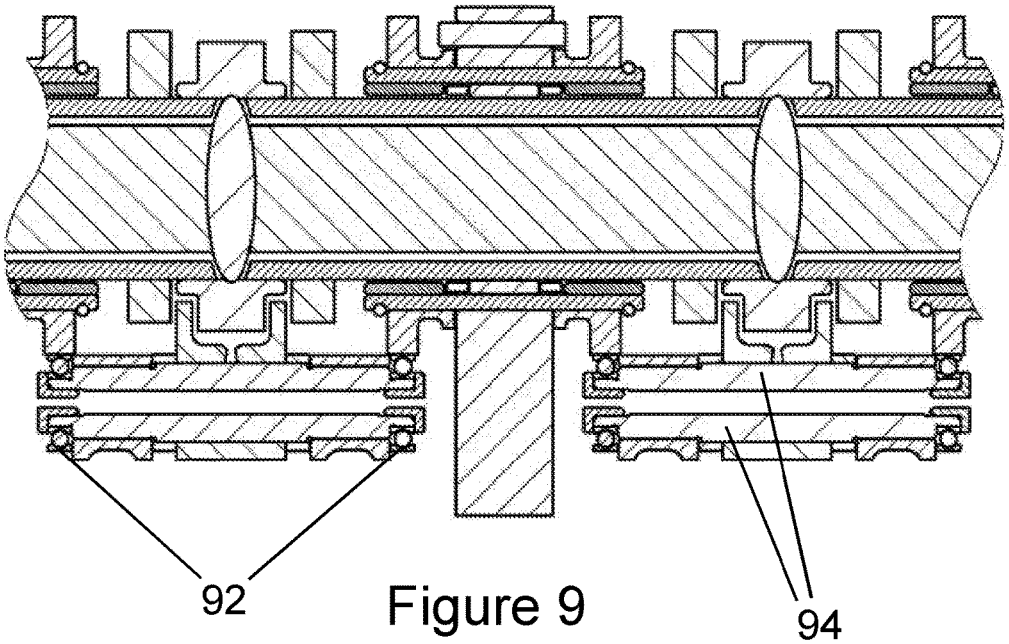
FIG. 9 shows a section view through a ninth embodiment of the present invention.

The ninth embodiment shown in FIG. 9 is very similar to both the seventh and eighth embodiments described above. It differs only in that the shim formations are replaced by a ball bearing race shim 92. This embodiment is advantageous if the pivot shaft 94 is fixed in rotation relative to the summation lever. When the summation lever then rotates, there is minimal friction between the ball race shim 92 and the pivot shaft 94.

Please note that it is not essential to use an eccentric adjuster with the ball race shim 92, a fixed component would equally be feasible, attached to the cam bearing raceway, which would interface with the ball bearing race on the pivot shaft of the VLD rocker system.

The invention claimed is:

1. A variable valve actuating mechanism comprising;

a camshaft having two concentric cam lobes that may be rotated relative to one another;

a summation lever engaging with both of the two concentric cam lobes;

a valve actuating rocker pivotally connected by a pivot shaft to the summation lever and engaging with a hydraulic lash adjuster at a first end and with a valve at a second end; and a shim surface movable with a pivot axis of the pivot shaft connecting the summation lever to the valve actuating rocker for limiting expansion of the hydraulic lash adjuster to control clearance in a rocker system including the valve actuating rocker, wherein in order to reduce friction, the shim surface abuts with a stationary stop surface that forms part of a camshaft support bearing:

wherein the stationary stop surface is an outer bearing race of a rolling element bearing, a bearing bush or a split bearing shell and the shim surface is on a separate shim component mounted on the pivot shaft connecting the summation lever to the valve actuating rocker.

2. The mechanism as claimed in claim 1, wherein a rolling element bearing is situated between the separate shim component and the pivot shaft.

3. The mechanism as claimed in claim 1, wherein the valve actuating rocker and the summation lever are pivotally connected by a pivot connection including a rolling element bearing.

4. The mechanism as claimed in claim 3, wherein a common rolling element bearing transfers loads from both the shim surface and the valve actuating rocker to the pivot shaft.

5. The mechanism as claimed in claim 1, further having an adjustment mechanism for altering position of the stationary stop surface against which the shim surface abuts to alter the clearance in the rocker system.

6. The mechanism as claimed in claim 5, wherein the adjustment mechanism alters the position of the stationary stop surface by incremental rotation of an eccentric surface rotating about the camshaft.

7. The mechanism as claimed in claim 6, wherein the eccentric surface is formed as part of the camshaft support bearing and the camshaft support bearing is fitted in a pair with another camshaft support bearing such that respective stop positions for the shim surface and another shim surface adjacent a common cylinder head mounting can be adjusted independently.

8. The mechanism as claimed in claim 1, wherein an additional component is assembled to the camshaft support bearing to provide the stationary stop surface.

9. The mechanism as claimed in claim 8, wherein the additional component is a rolling bearing.

10. The mechanism as claimed in claim 8, wherein the additional component has a graded part-cylindrical surface for setting the clearance in the rocker system.

11. The mechanism as claimed in claim 8, wherein the additional component acts to position the camshaft support bearing axially within a cylinder head journal.

12. The mechanism as claimed in claim 1, wherein the stationary stop surface is operative to permit passage of lubricant into the camshaft support bearing.

* * * * *